US011583856B2

(12) United States Patent
Wu et al.

(10) Patent No.: US 11,583,856 B2
(45) Date of Patent: Feb. 21, 2023

(54) BIO-INFORMATION DETECTION SUBSTRATE AND GENE CHIP

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Shenkang Wu, Beijing (CN); Dongsheng Huang, Beijing (CN); Tingze Dong, Beijing (CN); Jianxing Shang, Beijing (CN); Yizhe Li, Beijing (CN); Yue Geng, Beijing (CN); Jian Li, Beijing (CN); Guowei Chen, Beijing (CN); Hongliang Xu, Beijing (CN); Kuohai Wang, Beijing (CN); Chang Dai, Beijing (CN); Na Wei, Beijing (CN); Xin Li, Beijing (CN); Xiao Xin, Beijing (CN); Chao Sun, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 214 days.

(21) Appl. No.: 16/643,457

(22) PCT Filed: Apr. 2, 2019

(86) PCT No.: PCT/CN2019/081026
§ 371 (c)(1),
(2) Date: Feb. 28, 2020

(87) PCT Pub. No.: WO2020/199125
PCT Pub. Date: Oct. 8, 2020

(65) Prior Publication Data

US 2021/0252501 A1 Aug. 19, 2021

(51) Int. Cl.
*B01L 3/00* (2006.01)

(52) U.S. Cl.
CPC ..... *B01L 3/50273* (2013.01); *B01L 3/508* (2013.01); *B01L 2200/0689* (2013.01);
(Continued)

(58) Field of Classification Search
CPC ..... B01L 3/508; B01L 2200/0689; B01L 2200/10; B01L 2300/0803;
(Continued)

(56) References Cited

U.S. PATENT DOCUMENTS

2005/0123931 A1* 6/2005 Thompson ..... B01L 3/508 435/6.12
2005/0225751 A1* 10/2005 Sandell ..... B01L 3/5027 356/236
(Continued)

FOREIGN PATENT DOCUMENTS

CN 101609824 A 12/2009
CN 105460888 A 4/2016
(Continued)

OTHER PUBLICATIONS

Zhang et al., Translation of CN 205368331 U from IP.com, 11 pages (Year: 2016).*
(Continued)

*Primary Examiner* — Melanie Brown
*Assistant Examiner* — Jennifer H. Tieu

(57) ABSTRACT

A bio-information detection substrate and a gene chip are provided. The substrate includes a first main surface, the first main surface includes a test region and a dummy region located around the test region, at least one accommodation region is disposed on the first main surface, and the accommodation region is located in the dummy region.

19 Claims, 6 Drawing Sheets

(52) U.S. Cl.
CPC ... *B01L 2200/10* (2013.01); *B01L 2300/0803* (2013.01); *B01L 2300/0819* (2013.01); *B01L 2400/04* (2013.01)

(58) Field of Classification Search
CPC ..... B01L 2300/0819; B01L 3/00; B01L 2300/00; B01L 2200/00; G01N 1/00; G01N 1/28; G01N 1/31; G01N 1/312
See application file for complete search history.

(56) References Cited

U.S. PATENT DOCUMENTS

| | | | |
|---|---|---|---|
| 2012/0245042 | A1 | 9/2012 | Liu et al. |
| 2017/0144150 | A1 | 5/2017 | Wang et al. |
| 2020/0006390 | A1 | 1/2020 | Shin et al. |
| 2020/0164369 | A1 | 5/2020 | Li |

FOREIGN PATENT DOCUMENTS

| | | | | | |
|---|---|---|---|---|---|
| CN | 205368331 | U | * | 7/2016 | |
| CN | 207567249 | U | | 7/2018 | |
| CN | 108795732 | A | | 11/2018 | |
| CN | 109334028 | A | | 2/2019 | |
| CN | 109486676 | A | | 3/2019 | |
| CN | 208607473 | U | | 3/2019 | |
| CN | 208637458 | U | | 3/2019 | |
| EP | 3398681 | A1 | | 11/2018 | |
| EP | 3536774 | B1 | * | 6/2021 | ..... B01L 3/502707 |
| JP | 2000022313 | A | | 1/2000 | |
| WO | 2006052492 | A1 | | 5/2006 | |
| WO | 2016/036536 | A1 | | 3/2016 | |
| WO | WO-2018081920 | A1 | * | 5/2018 | ..... B01L 3/502707 |

OTHER PUBLICATIONS

Extended European Search Report dated Dec. 5, 2022; Appln. No. 19861238.4.

* cited by examiner

BIO-INFORMATION DETECTION SUBSTRATE AND GENE CHIP

TECHNICAL FIELD

At least one embodiment of the present disclosure relates to a bio-information detection substrate and a gene chip.

BACKGROUND

In recent years, research on biochips or microfluidic chips has attracted more and more attention. A typical microfluidic chip generally refers to a chip with a micron-sized detection unit which is integrated with processes of biological and chemical reaction, analysis, detection and the like. In the above-described chip producing process, chip packaging is an important part. However, a current packaging mode still cannot meet requirements in terms of flatness and sealing degree of the chip, which severely restricts performance of the chip.

SUMMARY

At least one embodiment of the present disclosure provides a substrate for bio-information detection, the substrate comprises a first main surface, the first main surface includes a test region and a dummy region located around the test region, at least one accommodation region is disposed on the first main surface, and the accommodation region is located in the dummy region.

For example, in the substrate provided by at least one embodiment of the present disclosure, the accommodation region is set as a first groove, and the first groove surrounds the test region.

For example, in the substrate provided by at least one embodiment of the present disclosure, the first groove includes at least one first sub-groove, and a planar shape of the first sub-groove on a surface of a second substrate is a closed ring.

For example, in the substrate provided by at least one embodiment of the present disclosure, a centroid of the closed ring coincides with a centroid of the test region.

For example, in the substrate provided by at least one embodiment of the present disclosure, distances from two opposite sides of the first sub-groove to the centroid of the test region are equal to each other.

For example, in the substrate provided by at least one embodiment of the present disclosure, the first groove includes at least one second sub-groove, and a planar shape of the second sub-groove on a surface of a second substrate is a line segment.

For example, in the substrate provided by at least one embodiment of the present disclosure, a plurality of the second sub-grooves are provided, and a centroid of a pattern formed by the plurality of the second sub-grooves coincides with the centroid of the test region.

For example, in the substrate provided by at least one embodiment of the present disclosure, there are two second sub-grooves, and the two second sub-grooves are symmetrical with respect to a center of the centroid of the test region; or there are no less than three second sub-grooves, and the second sub-grooves are equally spaced on a ring centered on the centroid of the test region.

For example, in the substrate provided by at least one embodiment of the present disclosure, at least one first through hole is disposed in a region of the substrate in which the first groove is disposed, and the first through hole communicates the first groove with a surface opposite to the first main surface.

For example, in the substrate provided by at least one embodiment of the present disclosure, a pattern formed by the first groove is symmetrical with the centroid of the test region as a reference center.

For example, in the substrate provided by at least one embodiment of the present disclosure, a plurality of the first grooves are arranged at intervals from an edge of the test region to an edge of the substrate; and the edge of the test region, the plurality of first grooves, and the edge of the substrate are equally spaced; or one first groove is provided between the edge of the test region and the edge of the substrate; and the edge of the test region, the first groove, and the edge of the substrate are equally spaced.

For example, the substrate provided by at least one embodiment of the present disclosure further comprises at least one second groove which is located in the test region and located on the first main surface of the substrate; the substrate includes second through holes located at both ends of the second groove; and the second through holes communicate the second groove with a surface opposite to the first main surface.

For example, in the substrate provided by at least one embodiment of the present disclosure, in a direction parallel to the first main surface, widths of the first groove and the second groove are equal to each other.

At least one embodiment of the present disclosure provides a gene chip, the gene chip comprises a first substrate, a second substrate and a sealant layer, the first substrate is the substrate according to any foregoing embodiment, the second substrate is provided opposite to the first substrate, the sealant layer is located between the first substrate and the second substrate, and at least partially located in the dummy region, and the sealant layer surrounds the accommodation region.

For example, in the gene chip provided by at least one embodiment of the present disclosure, the first substrate includes at least one second groove which is located in the test region and located on a first main surface of the first substrate, and at least two second through holes are disposed on the first substrate at a position where the second groove is disposed; and the second through holes go through the first substrate.

For example, in the gene chip provided by at least one embodiment of the present disclosure, the second substrate further includes a modification layer, and the modification layer is located on a surface of the second substrate that faces the first substrate.

For example, in the gene chip provided by at least one embodiment of the present disclosure, in a direction parallel to the first main surface, widths of the accommodation region and the second groove are equal to each other.

For example, in the gene chip provided by at least one embodiment of the present disclosure, the second substrate includes at least one second groove which is located in the test region and located on a surface of the second substrate that faces the first substrate, and the second substrate includes second through holes located at both ends of the second groove, and the second through holes go through the second substrate.

For example, in the gene chip provided by at least one embodiment of the present disclosure, the first substrate further includes a modification layer, and the modification layer is located on the first main surface of the first substrate.

For example, in the gene chip provided by at least one embodiment of the present disclosure, in a direction parallel to the first main surface, widths of the accommodation region and the second groove are equal to each other.

For example, in the gene chip provided by at least one embodiment of the present disclosure, the sealant layer comprises UV glue.

At least one embodiment of the present disclosure provides a preparation method of the gene chip according to any foregoing embodiment, the preparation method comprises: providing a first substrate, patterning a first main surface of the first substrate to form at least one accommodation region; providing a second substrate; coating sealant on the first main surface of the first substrate or a surface of the second substrate that faces the first main surface, the sealant being at least partially formed in a dummy region, and the sealant surrounding the accommodation region; cell-assembling the first substrate and the second substrate, the first main surface of the first substrate facing the second substrate; and curing the sealant to form a sealant layer.

For example, in the preparation method provided by at least one embodiment of the present disclosure, a method for curing a sealant layer includes at least one of laser bonding and UV curing.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

Figure 1A:
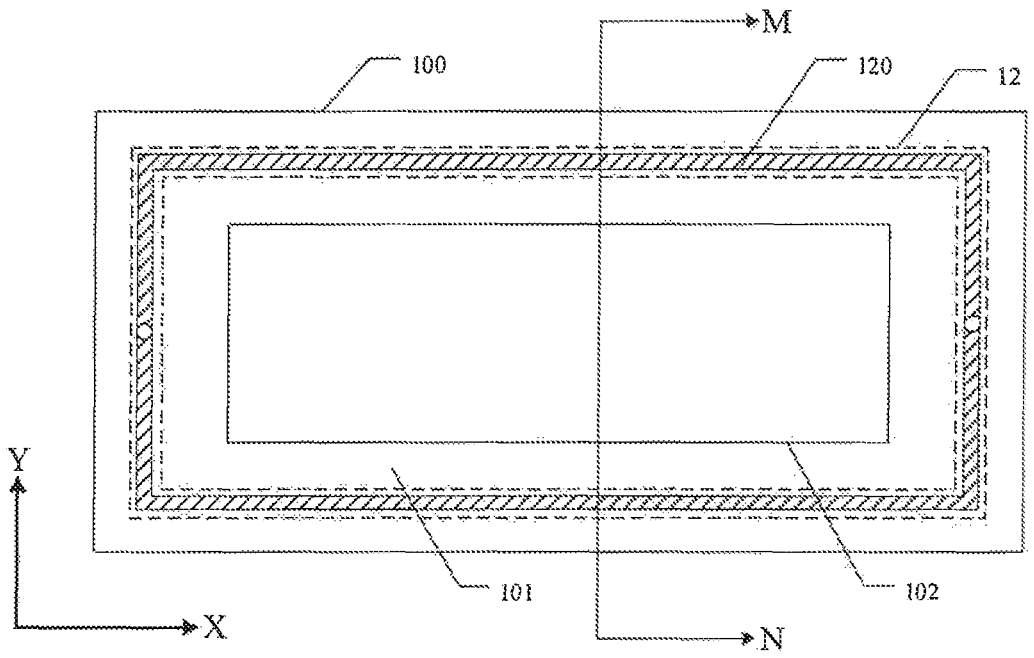
FIG. 1A is a plan view of a substrate provided by an embodiment of the present disclosure.

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

A gene chip is usually formed by cell-assembling two substrates, and a plurality of chambers for gene sequencing are formed between the two substrates. Therefore, parameters such as flatness and sealing degree of the two cell-assembled substrates will affect performance of the gene chip, thereby affecting accuracy of a gene sequencing result. With respect to a current gene chip, in a cell-assembling process, there may be an air bubble between the two substrates, and the air bubble is hard to be discharged after being squeezed, so that a channel communicating an inner side and an outer side is formed between the two substrates, which reduces the sealing degree of the gene chip; in addition, the air bubble will lead to uneven force distribution when the two substrates are press-fitted, thereby reducing the flatness of the gene chip. Therefore, by using the current cell-assembling technology, a packaging yield of the gene chip is limited.

At least one embodiment of the present disclosure provides a substrate for bio-information detection. The substrate comprises a first main surface; the first main surface includes a test region and a dummy region located around the test region; the first main surface is provided thereon with at least one accommodation region; and the accommodation region is located in the dummy region. The accommodation region has an accommodating function; in this way, when the substrate is cell-assembled with another substrate by using a sealant layer, an air bubble of the sealant layer will be introduced into the accommodation region after being pressed, thereby improving a packaging effect of the sealant layer. For example, the substrate may be used in a gene chip, to improve a packaging yield of the gene chip.

At least one embodiment of the present disclosure provides a gene chip, and the gene chip comprises a first substrate, a second substrate and a sealant layer. The first substrate is a substrate provided by the above-described embodiment of the present disclosure; the second substrate is provided opposite to the first substrate; the sealant layer is located between the first substrate and the second substrate and is at least partially located in the dummy region; and the sealant layer surrounds the accommodation region. The second substrate faces a first main surface of the first substrate. In a process of cell-assembling the first substrate and the second substrate to form the gene chip, when there is an air bubble in the sealant layer, the air bubble will enter the accommodation region under pressure without remaining in the sealant layer. In this way, a channel communicating an inner side and an outer side of the gene chip will not be generated in the sealant layer due to the air bubble; and the air bubble, after entering the accommodation region, will not affect force distribution when the first substrate and the second substrate are press-fitted, so as to improve flatness of the gene chip. As compared with the current gene chip, the gene chip according to the embodiment of the present disclosure has a packaging yield improved and costs reduced.

It should be noted that, in the embodiment of the present disclosure, it is only necessary to set the accommodation region to have an accommodating function, and based on this, a structure of the accommodation region may be designed according to needs. For example, in some embodiments, an accommodation region is set as a groove (e.g., a first groove), for example, the first groove surrounds a test region. In this way, after the first substrate and the second substrate are cell-assembled, the first groove may form a chamber, and an air bubble in a sealant layer may enter the chamber after being pressed. For example, in other embodiments, an accommodation region may be set as a concave-convex structure, so that the substrate has a concave-convex surface in the accommodation region. For example, the concave-convex structure is distributed around a test region. In this way, after the first substrate and the second substrate are cell-assembled, the concave-convex structure renders a gap between the first substrate and the second substrate, and an air bubble in a sealant layer will enter the gap under pressure.

Hereinafter, a technical solution in at least one of the following embodiments of the present disclosure will be described by taking the accommodation region as the first groove.

During use, the gene chip may be placed in an oil bath; if the sealant layer of the gene chip overflows, it will pollute an oil medium (e.g., silicone oil) in the oil bath, which will adversely affect a test result. In at least one embodiment of the present disclosure, a chamber formed by a first groove may provide a buffer space for extension of a sealant layer; and in a cell-assembling process, after the sealant layer is squeezed, a portion of the sealant layer may extend to the first groove, which reduces a risk that the sealant layer overflows from the gene chip, and thus may improve accuracy of a gene sequencing result.

Hereinafter, a bio-information detection substrate and a preparation method thereof, a gene chip and a preparation method thereof according to at least one embodiment of the present disclosure will be described in conjunction with the accompanying drawings.

Figure 1B:
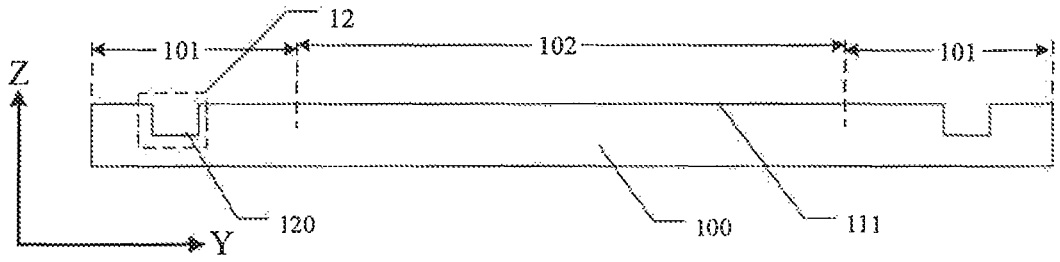
FIG. 1B is a cross-sectional view of the substrate shown in FIG. 1A along M-N.

FIG. 1A is a plan view of a substrate provided by an embodiment of the present disclosure; FIG. 1B is a cross-sectional view of the substrate shown in FIG. 1A along M-N; and the substrate may be used for bio-information detection, for example, gene sequencing.

At least one embodiment of the present disclosure provides a substrate, as shown in FIG. 1A and FIG. 1B, the substrate 100 comprises a first main surface 111; the first main surface 111 includes a test region 102 and a dummy region 101 around the test region 102; the first main surface 111 includes an accommodation region 12 located in the dummy region 101; and the accommodation region 12 is set as a first groove 120. In a packaging process in which the substrate 100 is used for cell-assembling, an air bubble in the dummy region 101 may be squeezed into the first groove 120. In this way, after the cell-assembling process is completed by using the substrate 100, there will be no air bubble in a packaging structure (e.g., a sealant layer), so that a packaging yield of a product formed by using the substrate 100 such as a gene chip is guaranteed.

The bio-information detection substrate may be used to form the gene chip. In at least one embodiment of the present disclosure, by taking that a bio-information detection substrate is used as a first substrate of a gene chip as an example, the bio-information detection substrate and a preparation method thereof, the gene chip and a preparation method thereof provided by at least one embodiment of the present disclosure will be described.

Figure 2A:
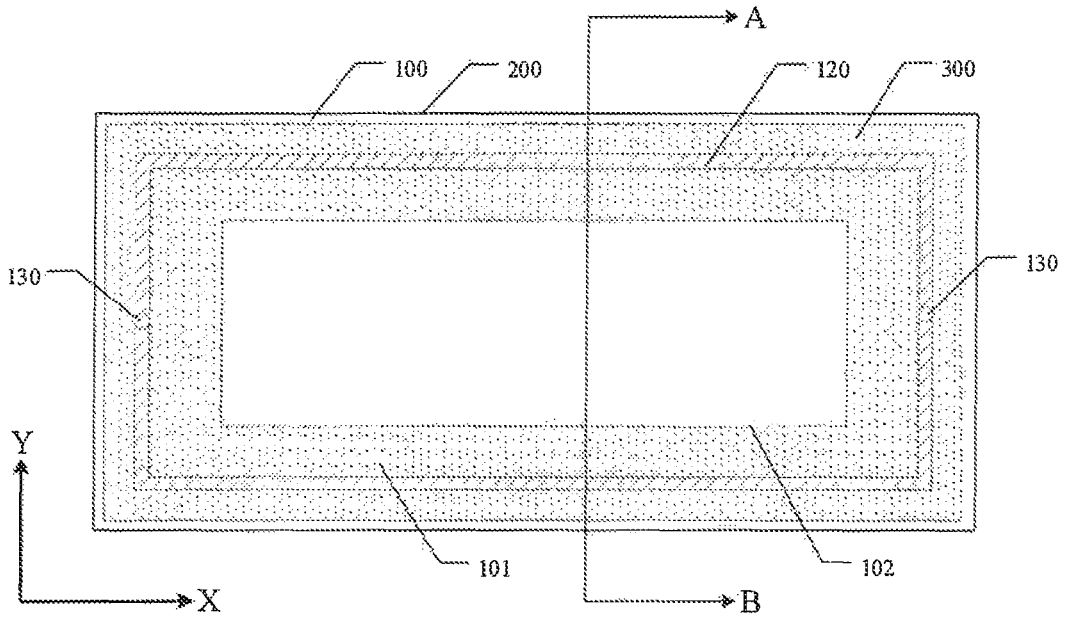
FIG. 2A is a structural schematic diagram of a gene chip provided by an embodiment of the present disclosure.
Figure 2B:
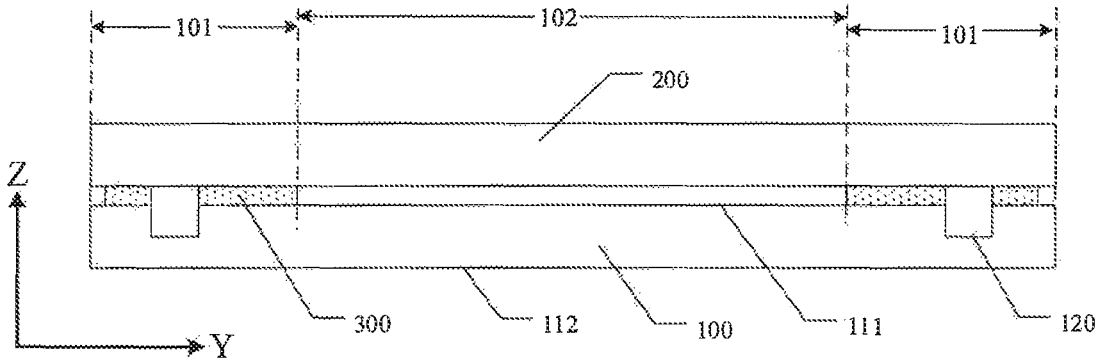
FIG. 2B is a cross-sectional view of the gene chip shown in FIG. 2A along A-B.
Figure 2C:
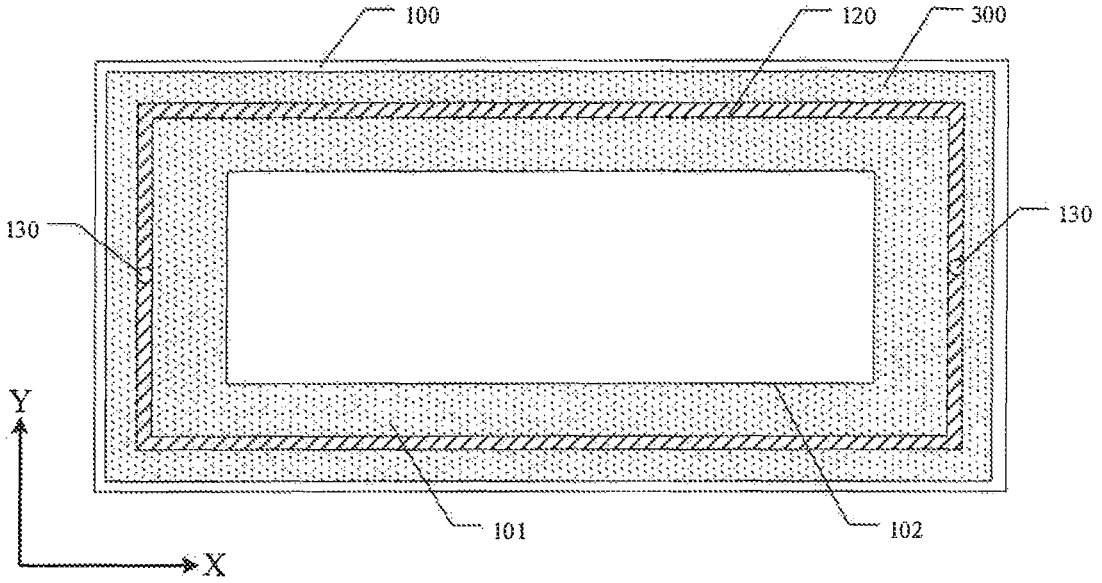
FIG. 2C is a plan view of a first substrate of the gene chip shown in FIG. 2A.

FIG. 2A is a structural schematic diagram of a gene chip provided by an embodiment of the present disclosure; FIG. 2B is a cross-sectional view of the gene chip shown in FIG. 2A along A-B; and FIG. 2C is a plan view of a first substrate of the gene chip shown in FIG. 2A. FIG. 2A, FIG. 2B and FIG. 2C only show a portion of a structure of a dummy region 101 of the gene chip.

At least one embodiment of the present disclosure provides a gene chip; and as shown in FIG. 2A, FIG. 2B and FIG. 2C, the gene chip comprises a first substrate 100, a second substrate 200 and a sealant layer 300. A first main surface 111 of the first substrate 100 includes a test region 102 and a dummy region 101 located around the test region 102; the first main surface 111 of the first substrate 100 is provided thereon with at least one first groove 120; and the first groove 120 is located in the dummy region 101. The second substrate 200 is provided opposite to the first substrate 100; and the first main surface 111 of the first substrate 100 faces the second substrate 200. The sealant layer 300 is located between the first substrate 100 and the second substrate 200; and the sealant layer 300 is at least partially located in the dummy region 101. The sealant layer 300 surrounds the first groove 120 and is broken at the first groove 120. In a process of cell-assembling the first substrate 100 and the second substrate 200, when there is an air bubble in the sealant layer 300, the air bubble will be squeezed into the first groove 120. In this way, after the first substrate 100 and the second substrate 200 are cell-assembled, there will be no air bubble in the sealant layer 300, so that in the sealant layer 300, there will be no channel communicating an inner side and an outer side as generated by the air bubble; in addition, after no air bubble is present in the sealant layer 300, a pressure during cell-assembling the first substrate 100 and the second substrate 200 may all be uniformly applied to the sealant layer 300, so that a thickness of the sealant layer 300 is uniform, thereby improving flatness of the gene chip.

For example, in at least one embodiment of the present disclosure, a first groove is provided around a test region, and the first groove is spaced from the test region. In this way, a sealant layer is provided between the first groove and the test region to avoid communication between the first groove and the test region; and in a process of cell-assembling the first substrate and the second substrate, in a case where an air bubble is present in the sealant layer, the air bubble around the test region may all be squeezed into the first groove.

In at least one embodiment of the present disclosure, design of a shape of a first groove and distribution thereof in a dummy region, etc. will not be limited, as long as the design is favorable for an air bubble of a sealant layer to enter the groove.

Figure 3A:
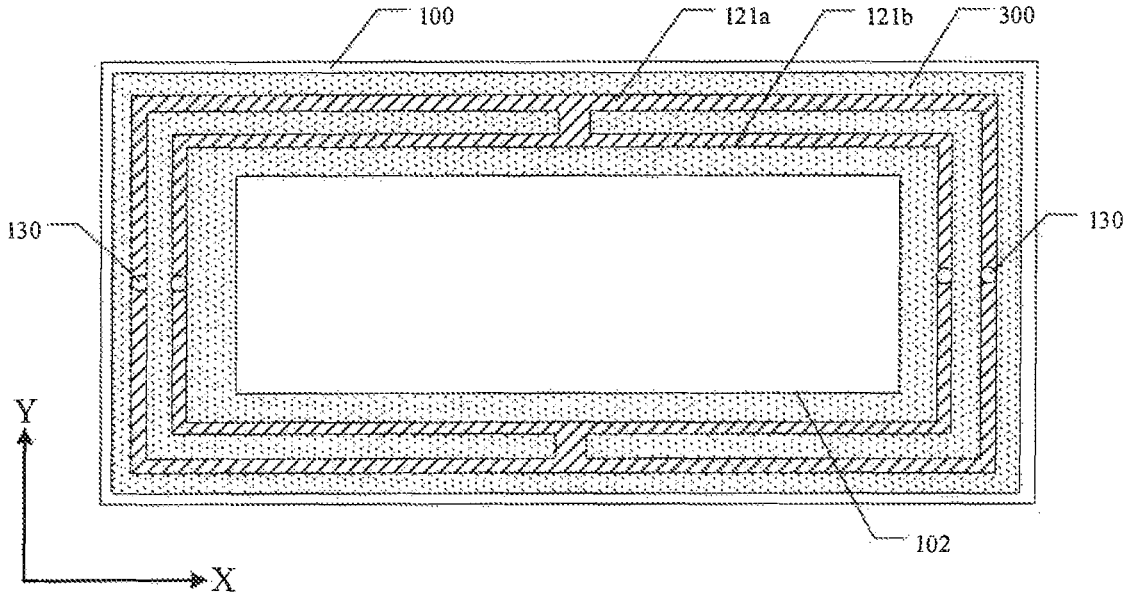
FIG. 3A is a plan view of a first substrate of a gene chip provided by an embodiment of the present disclosure.

For example, in at least one embodiment of the present disclosure, a first groove includes at least one first sub-groove; a planar shape of the first sub-groove on a surface of a second substrate is a closed ring; and the first sub-groove surrounds the test region. Exemplarily, as shown in FIG. 3A, the first groove includes two first sub-grooves 121*a*, 121*b*. The first sub-grooves 121*a* and 121*b* are both closed rings and surround a test region 102. In this way, at least with respect to an air bubble generated at any position in a dummy region (not shown, e.g., a region of a first substrate 100 other than the test region 102), during cell-assembling, the air bubble may enter the first groove 120 (e.g., a chamber formed by the first groove 120), so as to improve a packaging yield of a gene chip. For example, The first sub-grooves 121*a* and 121*b* are arranged as concentric rings, for example, the two first sub-grooves 121*a*, 121*b* are arranged as two rectangular rings, one encircled by another bigger one, for example, in a shape of "回".

In a region where the first groove of the gene chip is located, the first substrate and the second substrate will not be in contact with each other, so in the cell-assembling process, in a case where a gap between the first substrate and the second substrate is press-fitted to a predetermined thickness, a pressure required for press-fitting a region where the sealant is located is greater than a pressure required for press-fitting the region where the first groove is located. For example, in at least one embodiment of the present disclosure, in a case where a planar shape of the first sub-groove is a closed ring, a centroid of the closed ring coincides with a centroid of a test region. In this way, the first sub-groove may be evenly distributed with respect to the test region. In the cell-assembling process, force distribution is even on the whole when the first substrate and the second substrate are press-fitted; for example, with respect to regions on two opposite sides of the gene chip, pressures required for press-fitting the regions on the two sides in the cell-assembling process are equal to each other, so that flatness of the gene chip is improved. For example, in at least one embodiment of the present disclosure, a centroid of a test region coincides with a centroid of a surface of a substrate that is provided with a first groove. For example, the test region has a regular shape, for example, a rectangle, a circle, or an oval, etc. For example, an edge of the test region (a boundary line between the test region and a dummy region) may have a straight-line shape, a smooth curved-line shape, a wave shape, or a sawtooth shape, etc.

For example, in at least one embodiment of the present disclosure, distances from opposite two edges of the first sub-groove to a centroid of a test region are equal to each other. For example, as shown in FIG. 3A, a first sub-groove 121*a* is a rectangle, and a centroid of the rectangle coincides with a centroid of a test region 102. In a cell-assembling process, a distance between a first substrate 100 and a second substrate 200 is press-fitted to a predetermined value (e.g., a thickness of a sealant layer 300); a magnitude of a force to be applied is related to an amount of sealant layer 300; in a region with a large amount of sealant layer 300, greater pressure is required; and distribution of the first groove (the first sub-grooves 121*a*, 121*b*) will affect distribution of the sealant layer 300. According to the above-described design, the first sub-grooves 121*a*, 121*b* are evenly distributed in a dummy region of the first substrate 100, so that the sealant layer 300 is evenly distributed in the dummy region of the first substrate 100; and thus, in the cell-assembling process, the force distribution is even when the first substrate 100 and the second substrate 200 are press-fitted, which may improve flatness of the gene chip.

For example, in at least one embodiment of the present disclosure, a plurality of second sub-grooves are provided, and a centroid of a pattern formed by all the second sub-grooves coincides with a centroid of a test region. Thus, the second sub-grooves may be evenly distributed with respect to the test region. In a cell-assembling process, force distribution is even on the whole when a first substrate and a second substrate are press-fitted; for example, with respect to regions on two opposite sides of a gene chip, pressures required for cell-assembling the regions on the two sides in the cell-assembling process are equal to each other, so that flatness of the gene chip is improved.

For example, in at least one embodiment of the present disclosure, in a case where the first groove includes a plurality of first sub-grooves, the plurality of first sub-grooves may be in communication with each other. Exemplarily, as shown in FIG. 3A, two first sub-grooves 121*a*, 121*b* are in communication with each other; and thus, during cell-assembling, two chambers formed by the first sub-grooves 121*a* and 121*b* are also in communication with each other; pressures in the two chambers are equal to each other, and pressures are evenly distributed when a first substrate 100 and a second substrate 200 are press-fitted, which is favorable for improving flatness of a gene chip.

Figure 3B:
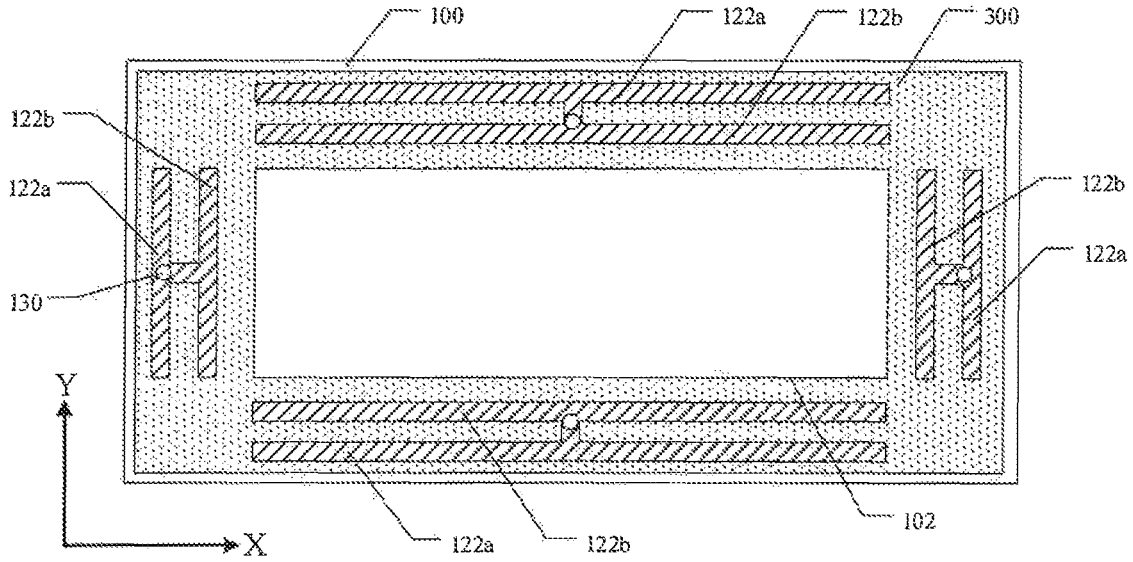
FIG. 3B is a plan view of another first substrate of a gene chip provided by an embodiment of the present disclosure.

For example, in at least one embodiment of the present disclosure, a first groove includes at least one second sub-groove; and a planar shape of the second sub-groove on a surface of a second substrate is a line segment. Exemplarily, as shown in FIG. 3B, a first groove includes two second sub-grooves 122*a*, 122*b* having a line-segment shape. From an edge of a dummy region (not shown, e.g., a region of a first substrate 100 other than a test region 102) to an edge of the test region 102, the second sub-grooves 122*a*, 122*b* are sequentially arranged at intervals. In this way, the first groove may be laid out according to a region where an air bubble is easily generated and an important specific region; and the first groove having a line-segment shape is formed on the first substrate 100, resulting in a low processing difficulty. For example, the line segment may be a straight-line segment as shown in FIG. 3B, or may also be set as a curved-line segment or other type of line segment.

It should be noted that, in the embodiment of the present disclosure, the planar shape of the first groove and the sub-grooves included therein (e.g., the first sub-groove and the second sub-groove, etc.) is a shape based on an extended trajectory (e.g., a length direction); the first groove and the sub-grooves included therein have a certain width in a width direction perpendicular to the extended trajectory. For example, as shown in FIG. 3A, planar shapes of the first sub-grooves 121*a*, 121*b* are both "回" shape (ring shape); and in a direction parallel to an X-Y plane, a separation distance (a width) between an inner side (a side facing the test region 102) and an outer side (a side facing away from the test region 102) of a rectangular ring (a "回" shape) is greater than zero. For example, as shown in FIG. 3B, planar shapes of second sub-grooves 122*a*, 122*b* are both straight-line segments; in the direction parallel to the X-Y plane, with respect to the second sub-grooves 122*a*, 122*b* constituting an "工" shape, a length direction is parallel to an X-axis, and a width direction is parallel to a Y-axis; with respect to second sub-grooves 122*a*, 122*b* constituting an "H" shape, a length direction is parallel to the Y-axis, a width direction is parallel to the X-axis, and widths of all second sub-grooves 122*a*, 122*b* in the width direction is greater than zero.

For example, in at least one embodiment of the present disclosure, there are two second sub-grooves, and the two second sub-grooves are symmetrical with respect to a centroid center of a test region; or, there are no less than three second sub-grooves, and the second sub-grooves are equally spaced on a ring centered on the centroid of the test region. Exemplarily, as shown in FIG. 3B, a second sub-groove 122*a* has a shape of a straight-line segment; on opposite sides of a test region 102, distances from two second sub-grooves 122*a* to a centroid of the test region 102 are equal to each other; and distances from two second sub-grooves 122*b* to the centroid of the test region 102 are equal to each other. In a cell-assembling process, a separation distance between a first substrate 100 and a second substrate 200 is press-fitted to a predetermined thickness; a magnitude of a force to be applied is related to an amount of the sealant layer 300; in a region with a large amount of sealant layer 300, greater pressure is required; and distribution of the first groove (second sub-grooves 122*a*, 122*b*) will affect distribution of the sealant layer 300. According to the above-described design, the second sub-grooves 122*a*, 122*b* may be evenly distributed in a dummy region of the first substrate 100, so that the sealant layer 300 is evenly distributed in the dummy region of the first substrate 100; and thus, in the cell-assembling process, the force distribution is even when the first substrate 100 and the second substrate 200 are press-fitted, which may improve flatness of a gene chip.

For example, in at least one embodiment of the present disclosure, a thickness of the sealant layer may be set to be no greater than 40 μm, and further, for example, no greater than 20 μm.

For example, in at least one embodiment of the present disclosure, in a case where a first groove includes a plurality of second sub-grooves, the plurality of second sub-grooves may be in communication with each other. Exemplarily, as shown in FIG. 3B, two second sub-grooves 122*a*, 122*b* are be in communication with each other, and thus, during cell-assembling, two chambers formed by 122*a* and 122*b* are also in communication with each other, air pressures in the two chambers are equal to each other; and pressures are evenly distributed when a first substrate 100 and a second substrate 200 are press-fitted, which is favorable for improving flatness of a gene chip. For example, in a case where the two second sub-grooves are in communication with each other, the two second sub-grooves may be formed into an "I" shape and an "H" shape as shown in FIG. 3B, or may also be a "U" shape and an "N" shape, etc.

Figure 3C:
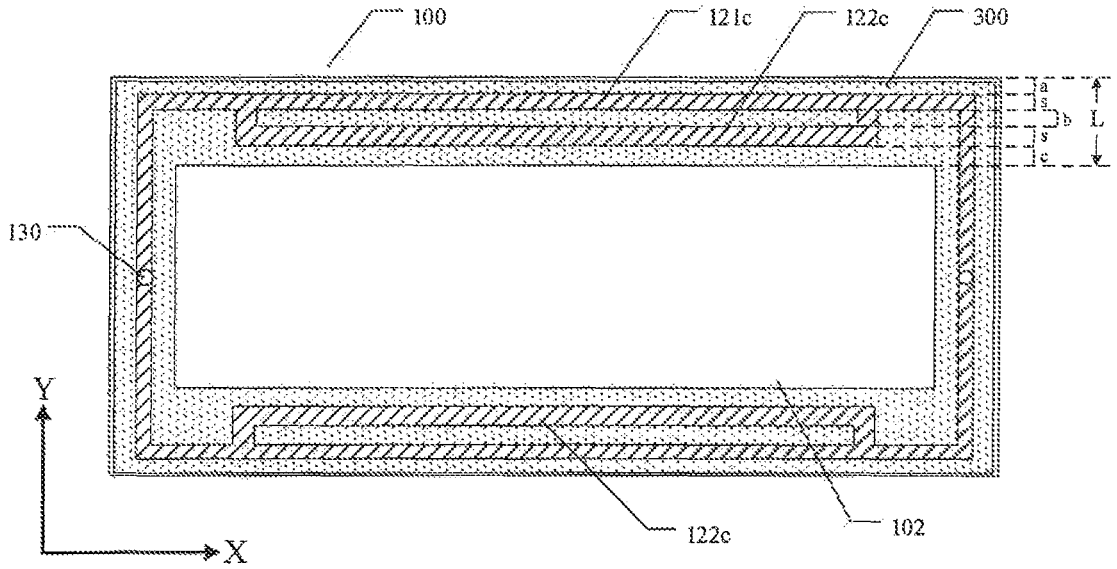
FIG. 3C is a plan view of another first substrate of a gene chip provided by an embodiment of the present disclosure.

For example, in at least one embodiment of the present disclosure, a first groove may include at least one first sub-groove and at least one second sub-groove. Exemplarily, as shown in FIG. 3C, a second sub-groove 122*c* having a line-segment shape is located between a test region 102 and a first sub-groove 121*c* having a closed-ring shape. For example, the second sub-groove 122*c* may be provided in a dummy region having a larger area. For example, the second sub-groove 122*c* is in communication with the first sub-groove 121*c*. Thus, a probability for an air bubble in a sealant layer 300 to enter the first groove may be increased, and a packaging yield of a gene chip after cell-assembling may be improved. Related description of the first sub-groove 121*a* according to the embodiment shown in FIG. 3A may be referred to for a structure of the first sub-groove 121*c*, and related description of the second sub-groove 122*a* according to the embodiment shown in FIG. 3B may be referred to for a structure of the second sub-groove 122*c*.

For example, in at least one embodiment of the present disclosure, a region of a first substrate in which a first groove is disposed is provided with at least one first through hole, and the first through hole communicates the first groove with a surface opposite to a first main surface. Exemplarily, as shown in FIG. 3A, FIG. 3B and FIG. 3C, a first through hole 130 is disposed at a first groove (the first sub-grooves 121*a*, 121*b*, 121*c*, and the second sub-grooves 122*a*, 122*b*, 122*c*). The first through hole 130 communicates the first groove with a second main surface 112 (as shown in FIG. 2B) of a first substrate 100. Thus, in a cell-assembling process, even if gas in an air bubble enters the first groove, a pressure intensity of a chamber formed by the first groove does not change, that is, pressure intensities of chambers formed by each of the first grooves are equal to each other; and pressures are evenly distributed when the first substrate 100 and a second substrate 200 are press-fitted, which is favorable for improving flatness of a gene chip.

For example, in at least one embodiment of the present disclosure, a pattern formed by a first groove is symmetrical with a centroid of a test region as a reference center. Thus, the first groove may be evenly distributed with respect to the test region. In a cell-assembling process, force distribution is even on the whole when a first substrate and a second substrate are press-fitted; for example, with respect to regions on two opposite sides of a gene chip, pressures required for cell-assembling the regions on the two sides in the cell-assembling process are equal to each other, so that flatness of the gene chip is improved.

For example, in at least one embodiment of the present disclosure, a plurality of first grooves are arranged at intervals from an edge of a test region to an edge of a first substrate, and the edge of the test region, the plurality of first grooves, and the edge of the first substrate are equally spaced; or, one first groove is provided between the edge of the test region and the edge of the first substrate, and the edge of the test region, the first groove, and the edge of the substrate are equally spaced. Exemplarily, as shown in FIG. 3C, on a same side of a test region 102, a separation distance a between an edge of a first substrate 100 and a first sub-groove 121*c* is equal to a separation distance b between the first sub-groove 121*c* and a second sub-groove 122*c*, and is equal to a separation distance c between the second sub-groove 122*c* and an edge of the test region 102. For example, widths s of the first sub-groove 121*c* and the second sub-groove 122*c* are equal to each other. Thus, pressures are evenly distributed when the first substrate 100 and a second substrate 200 are press-fitted, which is favorable for improving flatness of a gene chip.

In a substrate provided by at least one embodiment of the present disclosure, on a same side of a test region, the number of first grooves will not be limited, and may be designed according to parameters of a sealant layer, a width of a dummy region, a width of a first groove, and parameters of a related apparatus. For example, as shown in FIG. 3C, the set number of first grooves may be designed according to a formula $N \geq L/(\delta \times d+s)$. In the formula, N is the set number of the first grooves, L is a distance from a test region 102 to an edge of a first substrate 100; δ is an expansion coefficient of a material of a sealant layer under a condition for a cell-assembling process; d is a sealant width when a coating device coats sealant; and s is a width of the first groove. In FIG. 3C, on a same side of the test region 102, the first groove includes a first sub-groove 121*c* and a second sub-groove 122*c*, and N is 2.

Figure 4A:
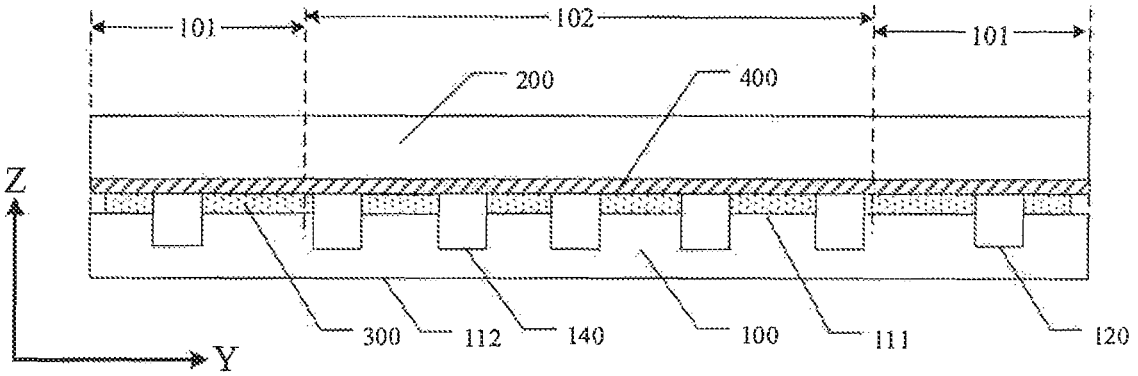
FIG. 4A is a cross-sectional view of a structure of the gene chip shown in FIG. 2B.
Figure 4B:
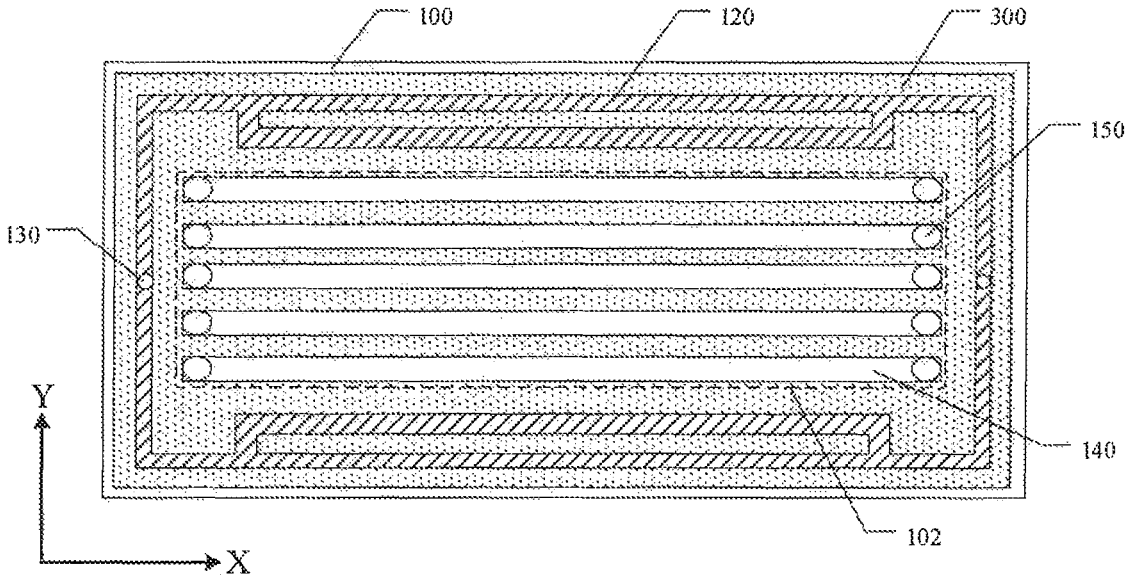
FIG. 4B is a plan view of a first substrate of the gene chip shown in FIG. 4A.

FIG. 4A is a cross-sectional view of a structure of the gene chip shown in FIG. 2B; and FIG. 4B is a plan view of a first substrate of the gene chip shown in FIG. 4A. FIG. 4A and FIG. 4B at least show a structure of a test region of the gene chip.

For example, in some embodiments of the present disclosure, a first substrate further includes at least one second groove. The second groove is located in a test region and located on a first main surface of the first substrate. At least two second through holes are provided on the first substrate at a position where the second groove is provided; and the second through holes communicate the second groove with a surface opposite to the first main surface. For example, both ends of the second groove are provided with a second through hole penetrating the first substrate. Exemplarily, as shown in FIG. 4A and FIG. 4B, in a test region 102, a plurality of second grooves 140 are arranged on a first main surface 111 of a first substrate 100; each second groove 140 is provided with two second through holes 150; the second through holes 150 communicate the second groove 140 with a second main surface 112 of the first substrate 100. After the first substrate 100 and a second substrate 200 are cell-assembled, the second groove 140 forms a chamber, and the chamber may be used as a reaction chamber for gene sequencing. In each reaction chamber, the two second through holes 150 may respectively serve as an inlet and an outlet for a material to be tested. For example, in the test region 102 of a gene chip, a region of the first main surface 11 of the first substrate 100 where the second groove 140 is provided is coated with a sealant layer 300. After cell-assembling, the sealant layer 300 may separate the chambers formed by the second grooves 140.

For example, the second through holes 150 may be provided at both ends of each second groove 140, so as to increase a flow path of a test fluid and improve test accuracy. Alternatively, the second through hole 150 may be provided at an arbitrary position in the second groove according to actual needs, and a separation distance between the two through holes 150 may be set according to needs.

For example, a second through hole has a conical degree that is not greater than 15°, and chipping that is not greater than 100 μm. For example, when the second through hole has a conical degree, with respect to the second through hole as an inlet, the second through hole may have a diameter of one end located in the second groove set to be larger than a diameter of the other end. Thus, when the fluid enters the second groove through the second through hole, a flow velocity of the fluid may be reduced (e.g., a laminar flow is formed), to avoid forming turbulence, which facilitates gene sequencing.

For example, in some embodiments of the present disclosure, in a direction parallel to a first main surface, widths of a first groove and a second groove are equal to each other. For example, as shown in FIG. 4A and FIG. 4B, widths of each first groove 120 and each second groove 140 are equal to each other. Thus, a processing difficulty of a first substrate 100 may be simplified, and costs may be reduced. For example, pressures are evenly distributed when the first substrate 100 and a second substrate 200 are press-fitted, which is favorable for improving flatness of a gene chip.

For example, in at least one embodiment of the present disclosure, in a case where a plurality of second grooves are provided, the number may be set to 5 to 20, for example, 8, 10, 16, or 18, etc. A depth of a second groove may be 50 μm to 200 μm, e.g., 80 μm, 100 μm, 120 μm, or 160 μm, etc. A width of the second groove may be 1 mm to 3 mm, for example, 1.2 mm, 1.8 mm, or 2.4 mm, etc. A separation distance between adjacent second grooves may be 0.5 mm to 2 mm, for example, 0.8 mm, 1 mm, 1.2 mm, or 1.6 mm, etc.

For example, in at least one embodiment of the present disclosure, in a case where a second groove is provided on a first substrate, a second substrate may further include a modification layer, and the modification layer is located on a surface of the second substrate that faces the first substrate. Exemplarily, as shown in FIG. 4A, a modification layer 400 may be used to match different gene fragments (or nucleotides), and different gene fragments may have different fluorescent labels (or isotope labels) thereon, so that genes may be sequenced according to distribution of the fluorescent labels along the modification layer 400. For example, the modification layer 400 may cover an entire surface of a second substrate 200 as shown in FIG. 4A, or may also be provided only in a region corresponding to a second groove 140.

For example, a material of the modification layer may include epoxy silane.

For example, in at least one embodiment of the present disclosure, in a reaction chamber formed by a second groove, a plurality of micro-reaction chambers may be provided to match different gene fragments, and thus, it may not be necessary to provide a modification layer. For example, in a position corresponding to the reaction chamber formed by the second groove, a plurality of arrayed micro-reaction chambers (e.g., micro grooves) are provided on a surface of a first substrate or a surface of a second substrate, and different micro-reaction chambers may be provided with different materials (e.g., target nucleotides of known sequences) to match specific gene fragments.

Figure 5A:
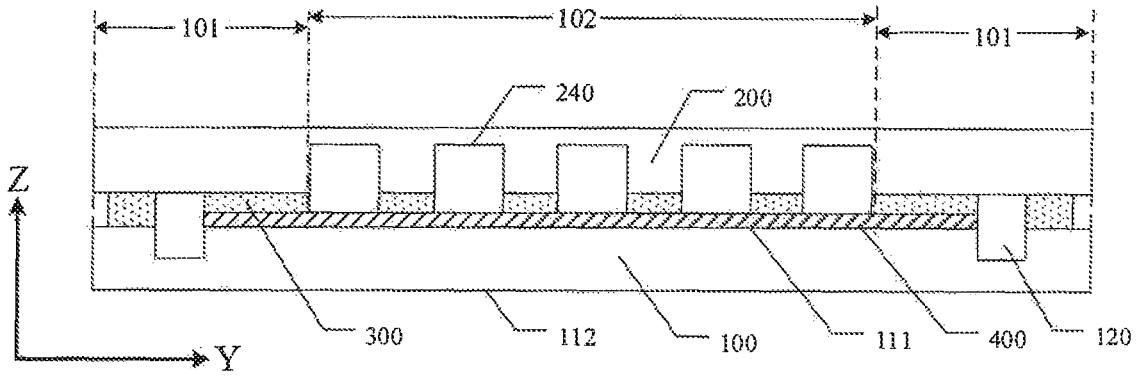
FIG. 5A is a cross-sectional view of another structure of the gene chip shown in FIG. 2B.
Figure 5B:
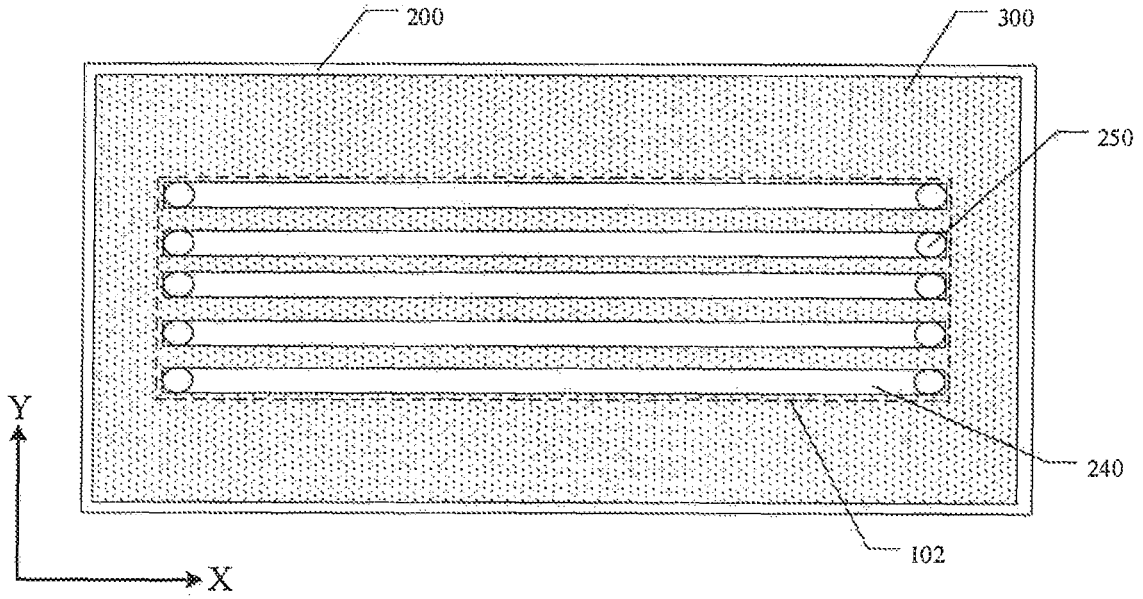
FIG. 5B is a plan view of a second substrate of the gene chip shown in FIG. 5A.

FIG. 5A is a cross-sectional view of another structure of the gene chip shown in FIG. 2B; and FIG. 5B is a plan view of a second substrate of the gene chip shown in FIG. 5A. FIG. 5A and FIG. 5B at least show another structure of a test region of the gene chip. For example, in other embodiments of the present disclosure, a second substrate includes at least one second groove; the second groove is located in a test region and located on a surface of the second substrate that faces a first substrate; the second substrate is provided with at least two second through holes at a position where the second groove is provided; and the second through holes go through the second substrate. Exemplarily, as shown in FIG. 5A and FIG. 5B, in a test region 102, a plurality of second grooves 240 are arranged on a surface of a second substrate 200 that faces a first substrate 100; two second through holes 250 are provided at each second groove 240; and the second through holes 250 go through the second substrate 200. After the first substrate 100 and the second substrate 200 are cell-assembled, the second groove 240 forms a chamber, and the chamber may serve as a reaction chamber for gene sequencing. In each reaction chamber, the two second through holes 250 may respectively serve as an inlet and an outlet for a material to be tested. For example, in the test region 102 of a gene chip, on a surface of the second substrate 200 that faces the first substrate 100, a region where the second groove 240 is not provided is coated with a sealant layer 300. After cell-assembling, the sealant layer 300 may separate the chambers formed by the respective second grooves 240.

For example, the second through holes 250 may be provided at both ends of each second groove 240, so as to increase a flow path of a test fluid and improve test accuracy. Alternatively, the second through holes 250 may be provided at arbitrary positions in the second groove according to actual needs, and a separation distance between the two through holes 250 may be set according to needs.

For example, in at least one embodiment of the present disclosure, in a case where a second groove is provided on a second substrate, a first substrate may further include a modification layer, and the modification layer is located on a first main surface of the first substrate. Exemplarily, as shown in FIG. 5A, a modification layer 400 may be used to match different gene fragments (or nucleotides), and different gene fragments may have different fluorescent labels thereon. Thus, genes may be sequenced according to distribution of the fluorescent labels along the modification layer 400. For example, on a first main surface, the modification layer 400 may cover the first main surface 111 in a test region 102 as shown in FIG. SA, or may also be provided only in a region corresponding to a second groove 140.

In at least one embodiment of the present disclosure, a type of a material of a sealant layer will not be limited, and the material may be selected according to a curing mode of the sealant layer.

For example, in some embodiments of the present disclosure, a curing mode of a sealant layer may be UV curing, and a material of the sealant layer may include UV glue. The UV glue has certain fluidity before being cured, and it is easy to deform under an external force. Thus, when a first substrate and a second substrate are cell-assembled, even if thickness distribution of the UV glue in respective regions is uneven, by squeezing the UV glue to make it flow, the thickness of the UV glue in the respective regions may also become even; in addition, the UV glue has fluidity, which, in a case of being squeezed, may also facilitate gas in an air bubble to enter a first groove. For example, the curing mode of the UV glue may be UV light irradiation, or may also include thermal curing. UV curing has advantages of simple operation, good sealing performance, and short curing time, which may improve production efficiency of a gene chip and reduce production costs.

For example, in a cell-assembling process, a certain pressure (e.g., a pressure intensity equivalent to 0.01 MPa to 1 MPa, for example, which is further a pressure intensity of 0.05 MPa, 0.1 MPa, or 0.5 MPa) may be applied to the first substrate and the second substrate, which is maintained for a certain time period (e.g., 5 s to 30 s, further, for example, 10 s), and then UV curing is performed on the sealant layer. For example, a UV light intensity for UV curing may be 1,000 mJ to 3,000 mJ, for example, which is further 2,000 mJ.

For example, in other embodiments of the present disclosure, a curing mode of a sealant layer may be laser bonding. For example, the sealant layer may be made of pure metal chromium, or silicon powder, etc.

At least one embodiment of the present disclosure provides a preparation method of the substrate according to any one of the above-described embodiments, the method comprising: patterning a first main surface of the substrate, to form at least one accommodation region in a dummy region of the substrate. With respect to the substrate obtained by using the method, in a packaging process in which the substrate is used for cell-assembling, an air bubble in the dummy region may be squeezed into the accommodation region. In this way, after the cell-assembling process is completed by using the substrate, no air bubble is present in a packaging structure (e.g., a sealant layer), so that a packaging yield of a product formed by using the substrate 100 such as a gene chip is guaranteed. Related description of the first substrate 100 according to the embodiments shown in FIG. 2A to FIG. 2C may be referred to for a structure of the substrate obtained by using the above-described method. For example, the patterning may be a photoetching patterning process, or may also be a machining process. Related description in the foregoing embodiments may be referred to for a setting mode of the accommodation region, for example, the accommodation region is set as a first groove, and the first groove surrounds a test region.

For example, in a preparation method of a substrate provided by at least one embodiment of the present disclosure, a formed first groove may include at least one first sub-groove; a planar shape of the first sub-groove on a surface of a second substrate is a closed ring; and the first sub-groove surrounds a test region. In this way, at least with respect to an air bubble generated at any position in a dummy region, during cell-assembling, the air bubble may all enter the first groove, so as to improve a packaging yield of a product obtained by using the substrate such as a gene chip. Related description of the first substrate 100 according to the embodiment shown in FIG. 3A may be referred to for a structure of the substrate obtained by using the method, and no details will be repeated here.

For example, in a preparation method of a substrate provided by at least one embodiment of the present disclosure, a first groove formed may include at least one second sub-groove; a planar shape of the second sub-groove on a surface of a second substrate is a line segment. In this way, the first groove may be laid out according to a region where an air bubble is easily generated and an important specific region; and the first groove having the line-segment shape is formed on the substrate, resulting in a low processing difficulty. Related description of the first substrate 100 according to the embodiment shown in FIG. 3B may be referred to for a structure of the substrate obtained by using the method, and no details will be repeated here.

For example, in at least one embodiment of the present disclosure, a first groove may include at least one first sub-groove and at least one second sub-groove. A planar shape of the first sub-groove on a surface of a second substrate is a closed ring and surrounds a test region; and a planar shape of the second sub-groove on a surface of a second substrate is a line segment. For example, the second sub-groove may be located in a dummy region having a larger area. Thus, a probability for an air bubble to enter the first groove may be increased, and a packaging yield of a product obtained by using the substrate such as a gene chip may be improved. Related description of the first substrate 100 according to the embodiment shown in FIG. 3C may be referred to for a structure of the substrate obtained by using the method, and no details will be repeated here.

For example, a preparation method of a substrate provided by at least one embodiment of the present disclosure, further comprises: forming at least one second groove in a test region of the substrate, and forming a second through hole penetrating the substrate at both ends of the second groove. Related description of the first substrate 100 according to the embodiment shown in FIG. 4B may be referred to for a structure of the substrate obtained by using the method.

At least one embodiment of the present disclosure provides a preparation method of the gene chip according to any one of the above-described embodiments, the method comprising: providing a first substrate, patterning a first main surface of the first substrate to form at least one accommodation region; providing a second substrate; coating sealant on the first main surface of the first substrate or a surface of the second substrate that faces the first main surface, the sealant being at least partially formed in a dummy region, and the sealant surrounding the accommodation region; cell-assembling the first substrate and the second substrate, the second substrate being located on the first main surface of the first substrate; and curing the sealant to form a sealant layer. For example, the accommodation region is set as a first groove, and the first groove surrounds a test region. Related description of the embodiments shown in FIG. 2A to FIG. 2C may be referred to for a structure of the gene chip obtained by using the above-described method.

For example, in a preparation method provided by at least one embodiment of the present disclosure, a method for curing a sealant layer includes at least one of laser bonding and UV curing. Related description of the foregoing embodiments may be referred to for a material type and a curing mode, etc. of the sealant layer, and no details will be repeated here.

With respect to the present disclosure, several points below need to be explained:

(1) The drawings of the embodiments of the present disclosure relate only to the structures involved in the embodiments of the present disclosure, and normal designs may be referred to for other structures.

(2) For the sake of clarity, in the drawings used for describing the embodiments of the present disclosure, thicknesses of layers or regions are enlarged or reduced, that is, these drawings are not drawn in an actual scale.

(3) In case of no conflict, the embodiments of the present disclosure and the features in the embodiments may be combined with each other to obtain a new embodiment.

The above are only specific embodiments of the present disclosure, but the scope of the embodiment of the present disclosure is not limited thereto, and the scope of the present disclosure should be the scope of the following claims.

The invention claimed is:

1. A substrate for bio-information detection, comprising a first main surface, the first main surface including a test region and a dummy region located around the test region, wherein at least one accommodation region is disposed on the first main surface, and the accommodation region is located in the dummy region, wherein the accommodation region comprises at least one first groove, and the at least one first groove surrounds the test region, wherein a sealant laver is located on the substrate and at least partially located in the dummy region, wherein N is a number of the first grooves, N is satisfied by a formula: $N \geq L/(\delta \times d+s)$, L is a distance from the test region to an edge of the substrate, δ is an expansion coefficient of a material of the sealant laver under a condition for a cell-assembling process, d is a width of a sealant when a coating device coats the sealant and s is a width of the first groove.

2. The substrate according to claim 1, wherein, the at least one first groove includes at least one first sub-groove, and a planar shape of each of the at least one first sub-groove on a surface of a second substrate is a closed ring.

3. The substrate according to claim 2, wherein, a centroid of the closed ring coincides with a centroid of the test region.

4. The substrate according to claim 3, wherein, distances from two opposite sides of each of the at least one first sub-groove to the centroid of the test region are equal to each other.

5. The substrate according to claim 1, wherein, the at least one first groove includes at least one second sub-groove, and a planar shape of each of the at least one second sub-groove on a surface of a second substrate is a line segment.

6. The substrate according to claim 5, wherein, a plurality of the second sub-grooves are provided, and a centroid of a pattern formed by the plurality of the second sub-grooves coincides with the centroid of the test region.

7. The substrate according to claim 6, wherein, there are two second sub-grooves, and the two second sub-grooves are symmetrical with respect to a center of the centroid of the test region; or there are no less than three second sub-grooves, and the second sub-grooves are equally spaced on a ring centered on the centroid of the test region.

8. The substrate according to claim 1, wherein, at least one first through hole is disposed in a region of the substrate in which the at least one first groove is disposed, and each of the at least one first through hole communicates the first groove with a surface opposite to the first main surface.

9. The substrate according to claim 1, wherein, a pattern formed by the at least one first groove is symmetrical with the centroid of the test region as a reference center.

10. The substrate according to claim 9, wherein, a plurality of the first grooves are arranged at intervals from an edge of the test region to an edge of the substrate; and the edge of the test region, the plurality of first grooves, and the edge of the substrate are equally spaced; or one first groove is provided between the edge of the test region and the edge of the substrate; and the edge of the test region, the first groove, and the edge of the substrate are equally spaced.

11. The substrate according to claim 1, further comprising:

at least one second groove, located in the test region and located on the first main surface of the substrate;

wherein the substrate includes second through holes located at both ends of each of the at least one second groove; and the second through holes communicate each of the at least one second groove with a surface opposite to the first main surface.

12. The substrate according to claim 11, wherein, in a direction parallel to the first main surface, widths of each of the at least one first groove and each of the at least one second groove are equal to each other.

13. A gene chip, comprising:

a first substrate, the first substrate being the substrate according to claim 1;

a second substrate, provided opposite to the first substrate; and the sealant layer, located between the first substrate and the second substrate;

wherein, the sealant layer surrounds the accommodation region.

14. The gene chip according to claim 13, wherein, the first substrate includes at least one second groove which is located in the test region and located on the first main surface of the first substrate, and at least two second through holes are disposed on the first substrate at a position where the at least one second groove is disposed; and the second through holes go through the first substrate.

15. The gene chip according to claim 14, wherein, the second substrate further includes a modification layer, and the modification layer is located on a surface of the second substrate that faces the first substrate.

16. The gene chip according to claim 14, wherein, in a direction parallel to the first main surface, widths of the accommodation region and each of the at least one second groove are equal to each other.

17. The gene chip according to claim 13, wherein, the second substrate includes at least one second groove which is located in the test region and located on a surface of the second substrate that faces the first substrate, and the second substrate includes second through holes located at both ends of each of the at least one second groove, and the second through holes go through the second substrate.

18. The gene chip according to claim 17, wherein, the first substrate further includes a modification layer, and the modification layer is located on the first main surface of the first substrate.

19. The gene chip according to claim 17, wherein, in a direction parallel to the first main surface, widths of the accommodation region and each of the at least one second groove are equal to each other.

* * * * *